US005978985A

United States Patent [19]

Thurman

[11] Patent Number: 5,978,985

[45] **Date of Patent: *Nov. 9, 1999**

[54] METHOD AND APPARATUS FOR ELASTIC SHOWER SPLASH GUARD

[76] Inventor: Michael A. Thurman, 280 W. Renner, Apt. 5211, Richardson, Tex. 75080

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,567

[22] Filed: Dec. 5, 1997

[51] Int. Cl.[6] ..... A47K 3/22

[52] U.S. Cl. ..... 4/609; 160/84.07

[58] Field of Search ..... 4/559, 609; D23/307; 160/DIG. 6, 84.01, 84.07, 84.04

[56] References Cited

U.S. PATENT DOCUMENTS

| | | | |
|---|---|---|---|
| 2,806,809 | 9/1957 | Schuh | 160/84.04 |
| 3,155,150 | 11/1964 | Silvestre | 160/84.04 |
| 3,386,106 | 6/1968 | Clemens | 160/84.07 |
| 3,855,642 | 12/1974 | Blitch | 4/609 |
| 3,984,880 | 10/1976 | Schrameyer | 4/146 |
| 4,944,050 | 7/1990 | Shames et al. | 4/609 |
| 5,222,261 | 6/1993 | Tooze et al. | 4/608 |
| 5,493,738 | 2/1996 | Sanderson et al. | 4/609 |
| 5,660,220 | 8/1997 | Ruan | 160/84.07 |

FOREIGN PATENT DOCUMENTS

| | | | |
|---|---|---|---|
| 2544976 | 11/1984 | France | 4/609 |
| 197806 | 6/1978 | Switzerland | 4/609 |

*Primary Examiner*—Charles R. Eloshway
*Attorney, Agent, or Firm*—John F. Bryan

[57] ABSTRACT

A splash guard for installation at the nominally orthogonal junction between a bath tub upper surface and an adjacent wall has two legs for attachment to the nominally orthogonal surfaces joined by a flexibly curved or convoluted web that flexes to adjust the angle between the legs, so as to allow them to be attached to surfaces that are set at greater or less than 90°. The flexible material required for this angular accommodation also serves to cushion impact against the body in falling accidents where the splash guard is involved.

5 Claims, 6 Drawing Sheets

FIG. 4
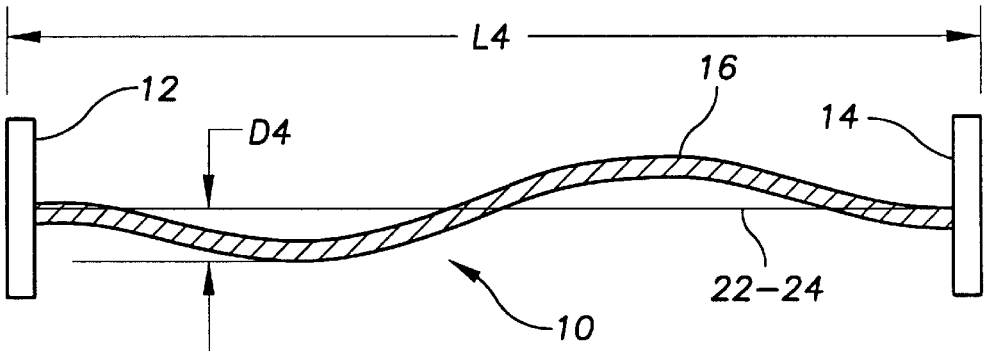
FIG. 5
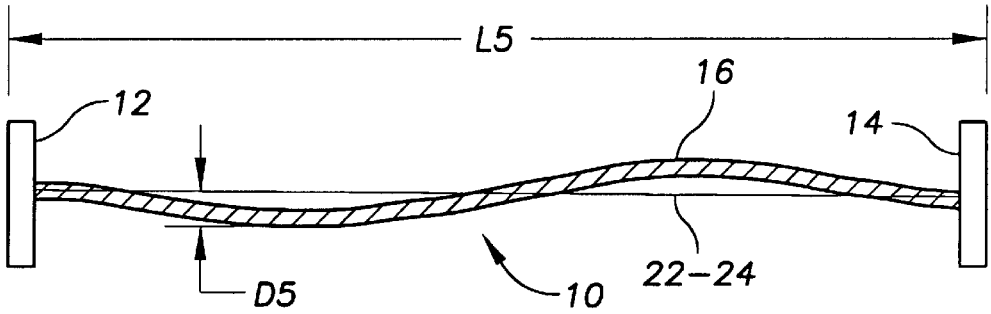
FIG. 6
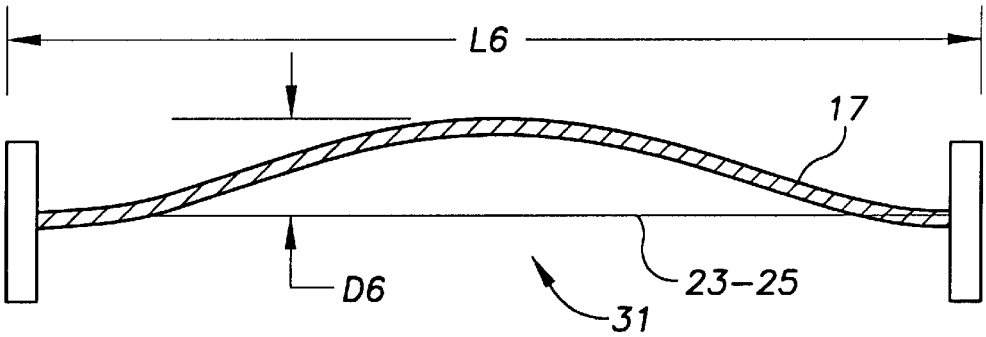
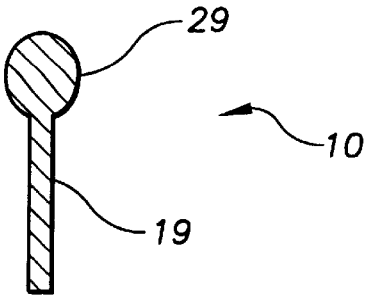
FIG. 7

METHOD AND APPARATUS FOR ELASTIC SHOWER SPLASH GUARD

FIELD OF THE INVENTION

The present invention relates to the field of shower curtain splash guards as fitted at the abutment of a bath tub and wall and most particularly, to such a device for use in installations where the junction angle varies from the ideal ninety degrees.

BACKGROUND AND SUMMARY OF THE INVENTION

It is a common practice to install a bath tub in a recessed part of the bathroom that serves as a shower enclosure. The walls of the recess are typically finished in a waterproof, usually tiled surface. A shower curtain running the length of the tub, over the open side of the recess, provides for shower entry and egress. The shower curtain is supported on a curtain rod by a plurality of slidable rings and hangs inside the bath tub, several inches below the top surface. However, there is a radiused internal corner and a ledge at each end of the tub, where the shower curtain tends to hang away from from the wall. This creates a potential leakage path along the wall at each end of the tub. Unless the user is extremely careful, shower splash and spray will find its way, past the shower curtain, along the end ledges and to the floor.

Such shower leakage has been addressed by commercially available splash guards, which may be mounted at one or both ends of the tub. The splash guard is fitted to the wall, on the top surface of the tub, where it blocks the leakage path along the end ledge. With the guard placed in this manner, just outside of the shower curtain, the curtain may then be tucked up against the inner face of the guard and the wall, to further improve protection against leakage.

There are inherent difficulties in the installation of such available splash guards. They are typically installed with a "peel-and-stick" adhesive backing that adheres to the wall and the tub rim. Since these surfaces are more-or-less perpendicular, it is difficult to bring the square profile of the guard into contact with one surface, without prematurely touching the other. The adhesive is aggressive by nature, and where it touches, it sticks. Another reality is that the enclosure walls are often not perfectly perpendicular to the tub. No matter, whether the angle acute or obtuse, the adhesive bond to either the tub or the wall will be incomplete, causing a weak joint and a gap that must be filled with tile grout.

Another consideration is safety. Getting in, or out of, the tub is hazardous at best, particularly for seniors. A rigid, relatively thin splash guard at the end of the tub can become a knife-like edge that poses a risk of severe injury. A fall, that otherwise might have resulted in a simple bruise, can cause a fracture or worse.

An object of the present invention is therefore, to provide a splash guard adapted for easy installation and removal. A second object that this splash guard should have the capability to conform to installation where the walls are not exactly perpendicular to the tub rim. A third object is to provide a splash guard that does not impose an increased risk to the user in case of a fall. Yet another object is to achieve all of the foregoing attributes in a splash guard that is aesthetically pleasing yet inexpensive to manufacture.

The present invention accomplishes these objectives by providing a splash guard made of an inherently flexible and deformable elastomeric material. This splash guard includes attaching legs fitting to the wall and tub in a nominal 90° installation, but provides a curved or wave-form connecting web that deforms to allow angular variations. An increase or decrease of the web curvature provides the requisite angular accommodation. The force required to deform the web is significantly less than the adhesive bond strength attaching the legs of the guard to the wall and tub. This same material mitigates the added hazard of conventional splash guard installations by allowing the splash guard of the present invention to flex or deform under impact rather than act as a rigid, knife-like edge.

DESCRIPTION OF THE DRAWINGS

The aforementioned and other objects and features of the invention will be apparent from the following detailed description of specific embodiments thereof, when read in conjunction with the accompanying drawings, in which:

FIG. 4 is a section view of the splash guard of FIG. 2;

FIG. 5 is a section view of the splash guard of FIG. 3;

FIG. 6 is a view, similar to FIGS. 4 & 5, of an alternative preferred embodiment of the present invention;

FIG. 7 is a cross-section view of an alternative web for the splash guard of FIGS. 4, 5, and 6;

DETAILED DESCRIPTION OF THE DRAWINGS

Figure 1:
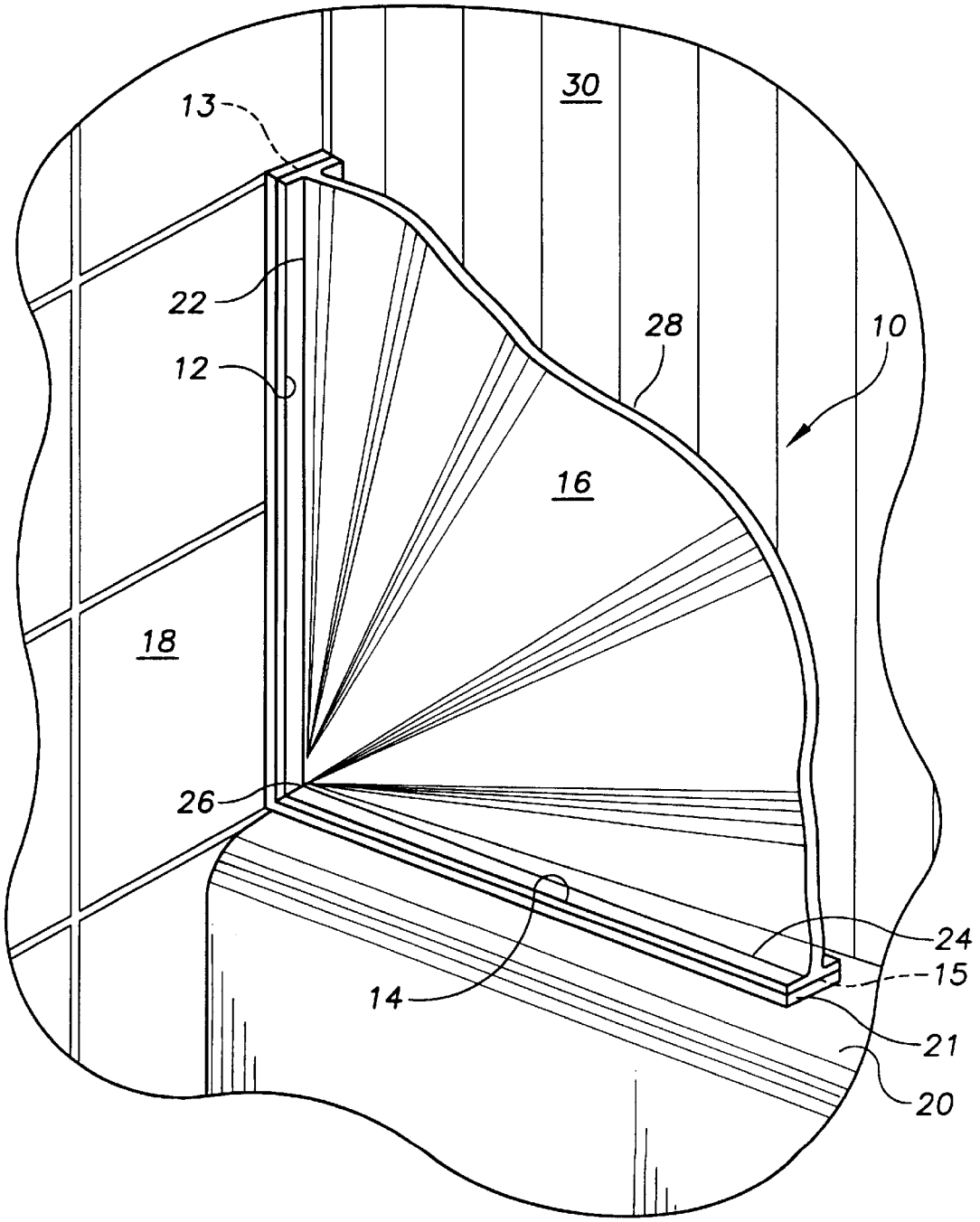
FIG. 1 shows a preferred embodiment of the present invention.

FIG. 1 shows a preferred embodiment of the present invention as elastomeric splash guard 10. Vertical leg 12 and horizontal leg 14 are connected by relatively thin flexible web 16 and shower curtain 30 hangs behind splash guard 10, abutting wall surface 18. The outer surfaces 13 and 15 of vertical leg 12 and horizontal leg 14 are attached to wall surface 18 and bath tub top surface 20 respectively by adhesive strip 21. Splash guard 10 is of one-piece, molded construction, made of an elastomeric material, with flexible web 16 transitioning into vertical leg 12 and horizontal leg 14. These transitions are along straight lines 22 and 24, which are more or less centered on the width of legs 12, and 14 and intersect at apex 26, so as to define plane 22–24, as is later shown in FIGS. 4 & 5. Edge 28 is deformable, according to the properties of the molded elastomer, and may be the thickness of flexible web 16, as shown in FIG. 1, or thicker, for tear resistance, as later shown in FIG. 6.

Figure 2:
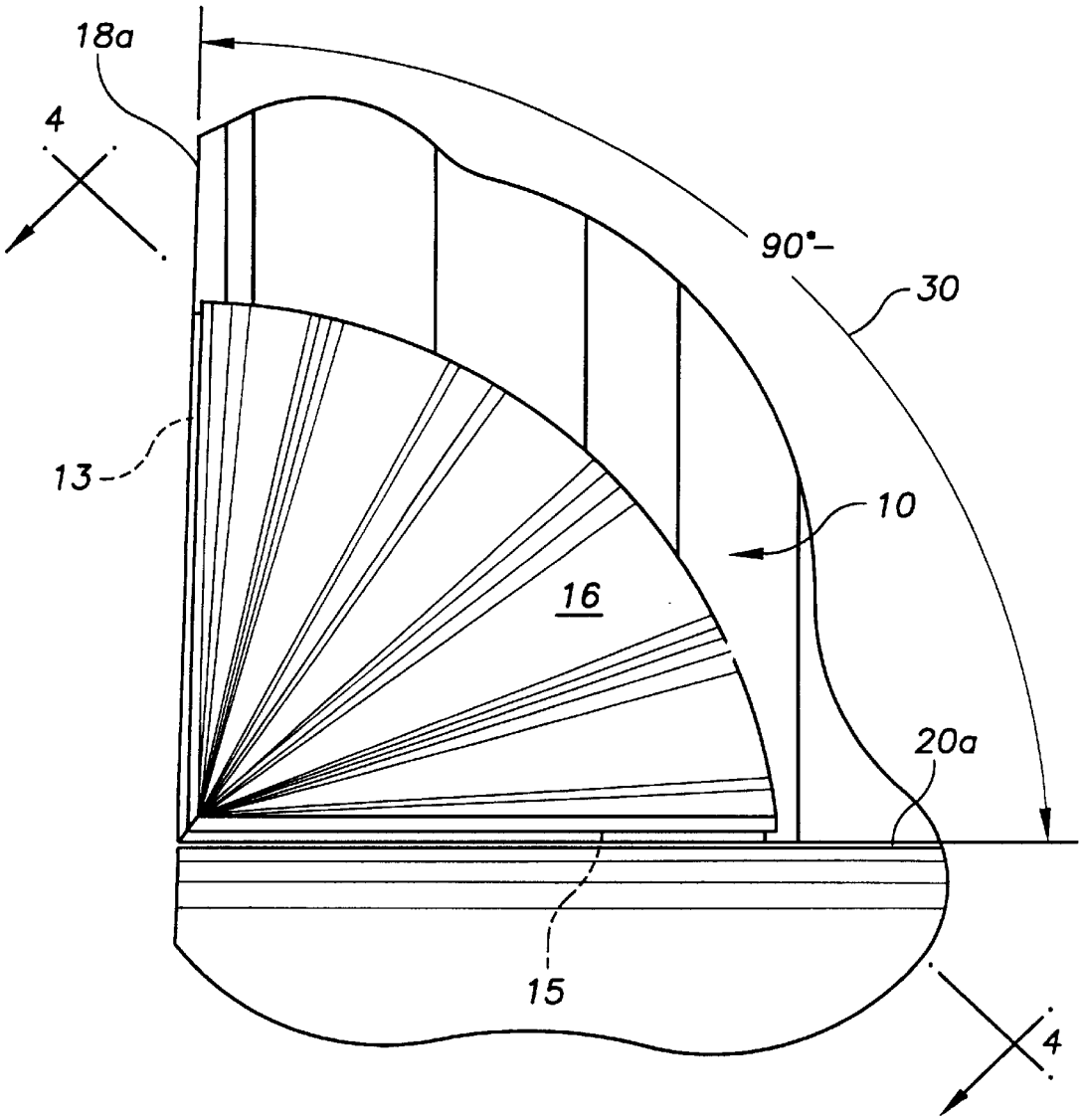
FIG. 2 is a view of the splash guard of FIG. 1 as it appears when placed in an acutely angled installation.
Figure 3:
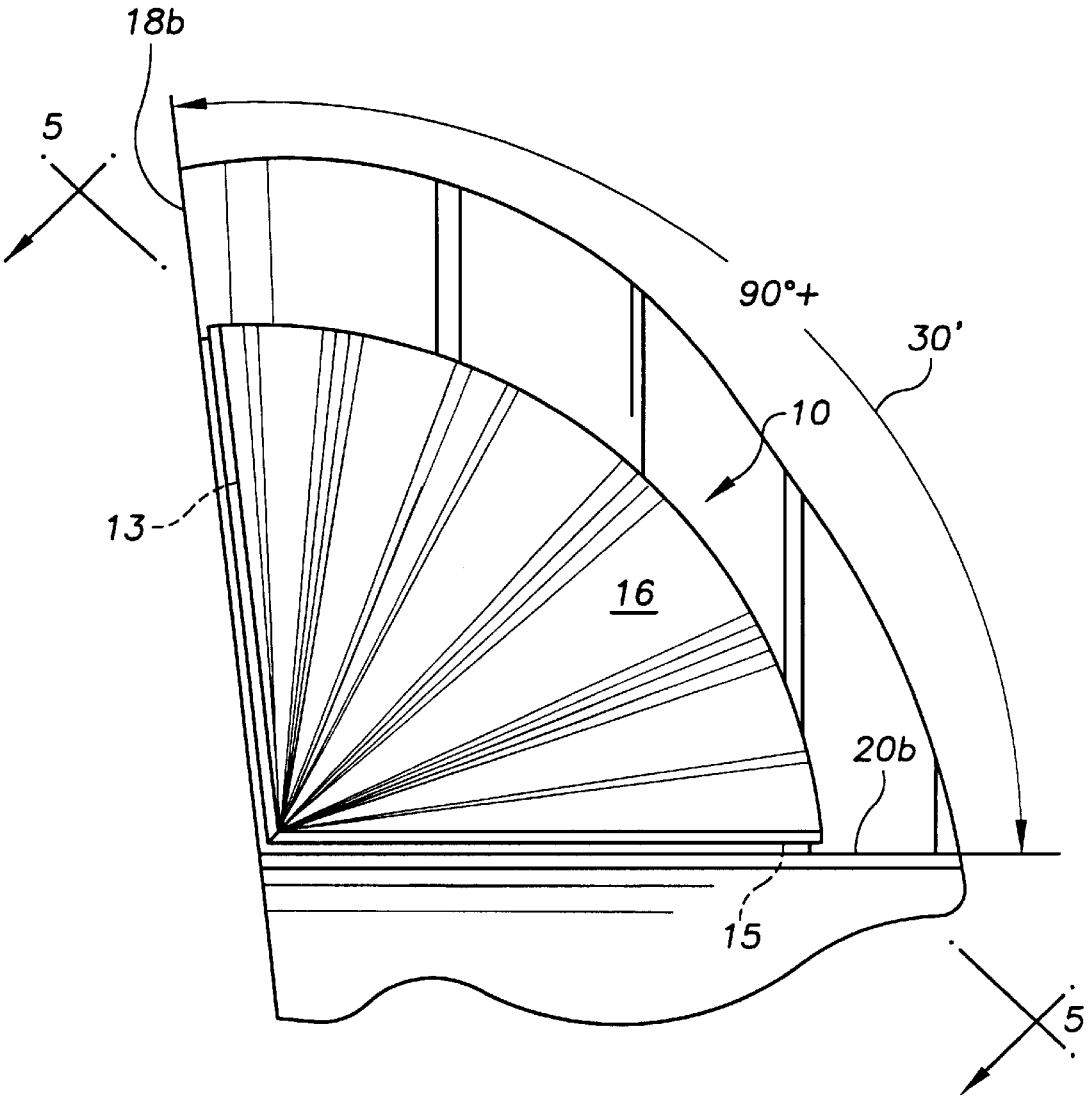
FIG. 3 is a view of the splash guard of FIG. 1 as it appears when placed in an obtusely angled installation.

FIGS. 2 and 3 show the installation of splash guard 10 under circumstances wherein wall surface 18*a* is not plumb, so that its included angle with tub top surface 20*a* is less than 90° as shown in FIG. 2.

Conversely, wall surface 18*b* of FIG. 3 might be out of plumb so that its included angle with top tub surface 20*b* exceeds 90°. Flexible web 16 is gently wave-formed, or curved, no portion of flexible web 16 being stiffened by folding into intersecting planes as shown in FIGS. 4 and 5 or FIG. 6, so that some portion of its span curves outside of plane 22–24. The included angle between outer surfaces 13 and 15 may be varied from acute, as shown in FIG. 2 to obtuse, as shown in FIG. 3 by flexure of web 16.

FIGS. 4 and 5, showing section 4—4 of FIG. 2 and 5—5 of FIG. 3, illustrate how the flexure of web 16 acts to allow variations of the included angle 30 and 30' between vertical leg 12 and horizontal leg 14. The significant angularity difference between FIGS. 4 and 5 is evidenced by the greater length L5 of section 5—5 (FIG. 5) as compared to length L4 of section 4—4 (FIG. 4). This difference in angles 30 and 30' in FIGS. 2 & 3 is accommodated by the relative degree of curvature of wave-form web 16 from plane 22–24 as shown by displacements D4 and D5. At some maximum obtuse angle, greater than 30' shown in FIG. 3, flexible web 16 will become flat, and as the included angle decreases from that maximum, the displacement from plane 22–24 increases. This is shown by comparing displacement D5 of FIG. 5 to displacement D4 of FIG. 4. It should be noted that the deformation of web 16 is distributed along its span between legs 12 and 14. Thus, the angle between legs 12 and 14 is varied from greater than 90° to less than 90° by flexibly changing the degree of curvature of web 16. Web 16 is preferably molded with a degree of curvature appropriate to the greatest obtuse angle likely to be encountered in an installation so that adhesive 21 is not required to act under tension. However, the force required along plane 22–24 to alter the degree of curvature of web 16 should be much less than the tensile capability of adhesive 21. FIG. 6 shows splash guard 31 having an alternative web 17, which is curved to one side of plane 23–25 rather than to alternating sides. Section length L6 is the same as section length L4, so the effect would be the same insofar as accommodating included angle 30, but D6 is greater than D4 since the displacement is all to one direction rather than two.

FIG. 7 shows a partial section view of splash guard 10 with web 19, an alternative variation of webs 16 and 17, wherein a thickened, continuous outer edge 29 is included for improved tear resistance. The use of edge 28 or edge 29 and specific section dimensions is a designer's choice, based on the properties of the particular material formulation selected for manufacture.

Figure 8:
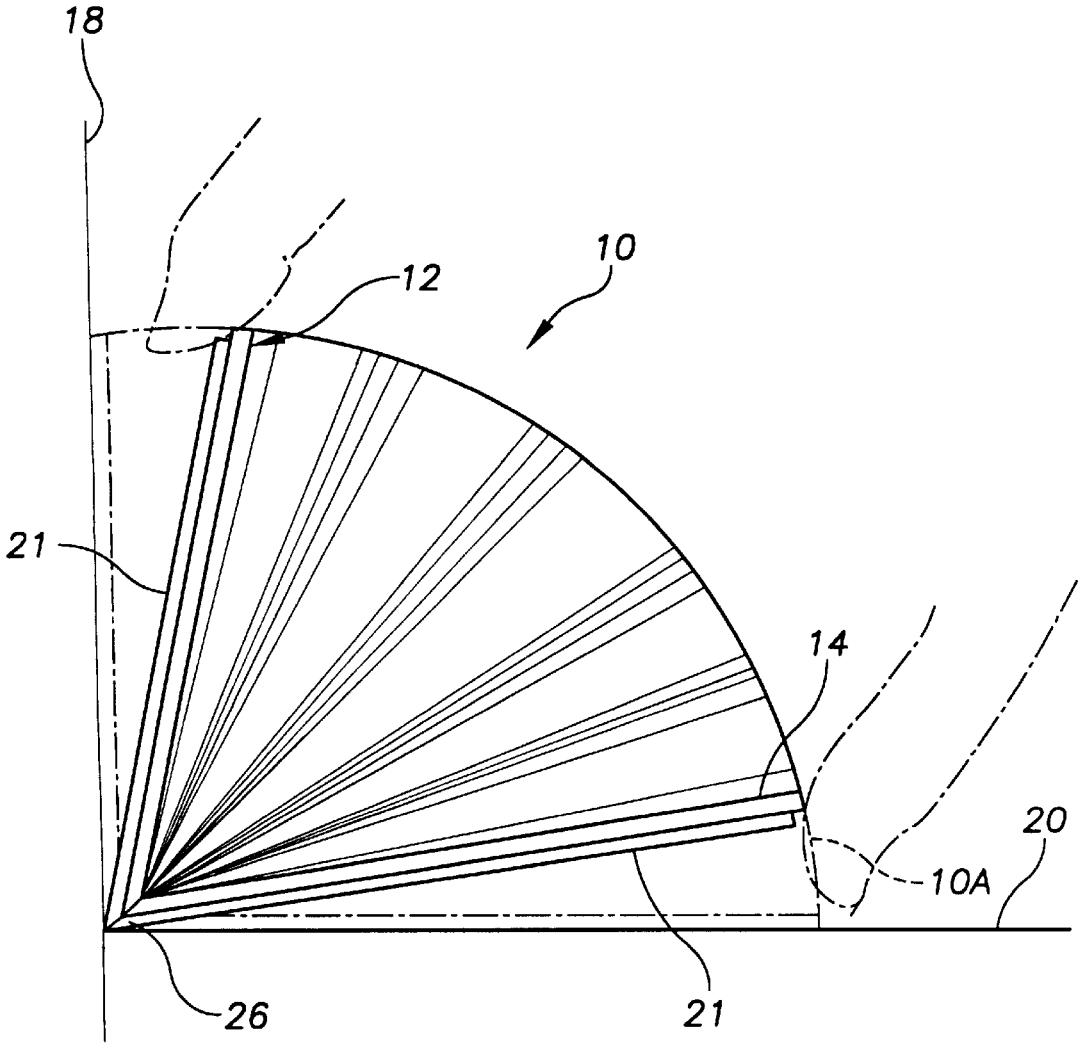
FIG. 8 shows the method of installing the preferred embodiment of FIG. 1.

FIG. 8 shows the method for installing splash guard 10, which overcomes the previously described difficulty of properly placing a conventional, rigid splash guard. Vertical leg 12 is compressed toward horizontal leg 14 so as to significantly reduce the angle therebetween and allow apex 26 to be placed at the nominally perpendicular junction of wall surface 18 and bath tub top surface 20, without making accidental contact with adhesive 21. Once apex 26 is properly placed, with vertical leg 12 and horizontal leg 14 in a plane substantially perpendicular to wall surface 18 and tub surface 20, compression is relaxed and adhesive 21 is allowed to make contact with wall surface 18 and tub surface 20 as shown by the phantom lines indicating expanded splash guard 10A. Legs 12 and 14 are then pressed firmly against surfaces 18 and 20, insuring a firm bond and completing the installation.

Figure 9:
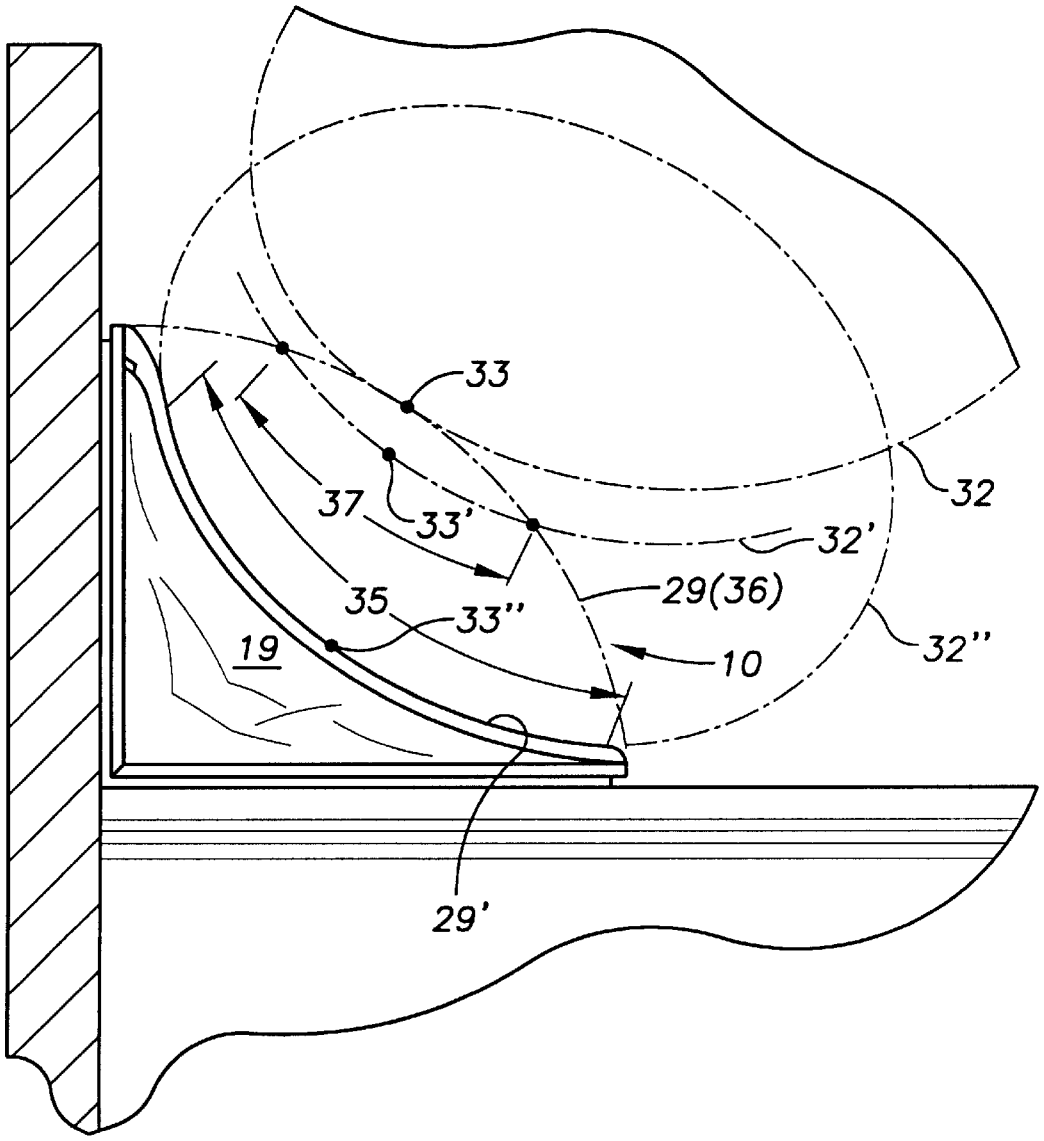
FIG. 9 shows the preferred embodiment of FIG. 1 as it appears when deformed under impact.

FIG. 9 shows how splash guard 10 of the present invention, with elastic web 19 and deformable edge 29 act to distribute the impact of a person falling thereagainst through gross deformation. The person makes first falling contact in position 32 at point 33 and maintains contact until the the energy of impact is fully dissipated at position 32" and point 33". In the case of a fall against conventional rigid splash guard 36, which would not deflect significantly and can therefore, be represented by undeflected edge 29, first contact would again be shown by position 32 at point 33. The same energy of impact would however, be dissipated at the point of maximum penetration 33', when downward progress of the person is arrested much more quickly, at position 32'. It is also noteworthy that rigid splash guard 36 not only arrests the fall in a shorter period of time, but that the impact energy is distributed over the smaller area represented by dimension 37 as compared to the equivalent dimension 35 at position 32" with splash guard 10 of the present invention. Inasmuch as the impact energy of the falling person is distributed over a greater area and a longer period of time, the force of the blow is diminished proportionately, as is the severity of the potential injury.

Although the preferred and alternative embodiments of the invention have been illustrated in the accompanying Drawings and described in the foregoing Detailed Description, it is to be understood that the present invention is not limited to the disclosed embodiments, but is capable of numerous modifications without departing from the scope of the invention as claimed.

I claim:

1. A splash guard for installation in the junction of the nominally vertical shower enclosure wall to the nominally horizontal bath tub top surface of a shower bath, enclosed by a shower curtain, comprising:

a first base leg, including first inner and outer surfaces, said outer surface further including adhesive for attachment thereof to the nominally vertical wall;

a second base leg, including second inner and outer surfaces, said outer surface further including adhesive for attachment thereof to the nominally horizontal tub top surface;

an elastic web integrally joining said first inner surface along a first line and said second inner surface along a second line so as to place said first and second outer surfaces in a nominally orthogonal relationship, the cross-section of said web having a continuous, sinusoidal wave-form curvature to alternating sides of the plane defined by said first and second lines so that no portion of said flexible web is stiffened by folding into intersecting planes; and the angle between said first and second outer surfaces being variable from greater than 90° to less than 90° by flexibly changing the degree of curvature of said web.

2. A splash guard according to claim 1 wherein an adhesive strip is applied to the length of said first and second outer surfaces.

3. A splash guard according to claim 1 wherein said elastic web includes an inner portion of substantially uniform thickness and a continuous, uniformly thicker outer edge portion.

4. A method for installing a splash guard in the approximately orthogonal junction of the shower enclosure wall to the bath tub top surface of a shower bath, enclosed by a shower curtain, comprising the steps of:

constructing a splash guard with approximately orthogonal first and second legs joined by a continuous, sinusoidally curved elastic web, so that no portion of said web is stiffened by folding into intersecting planes;

applying adhesive to the outer surface of the legs;

flexing the alternating concave and convex curvature so as to reduce the included angle between the legs to an acute angle, significantly less than the approximately orthogonal angle between the wall and the bath tub top surface, by pressing the legs toward each other;

fitting the apex of the acute angle into the apex of the approximately orthogonal angle;

relaxing the pressure urging the acute angle between the legs so as to allow the included angle between the legs to approach the angle between the wall and the tub surface, as the first leg approaches a position substantially perpendicular to the top surface of the tub and the second leg approaches a position substantially perpendicular to the wall; and pressing the first leg against the wall and the second leg against the top surface of the tub.

5. A method for improving the safety of a shower splash guard installation attached to the wall surface and bath tub top surface of a shower enclosure, in the approximately orthogonal junction therebetween, comprising the steps of:

connecting the wall and tub top surface attachment portions of the splash guard with a continuously, sinusoidally curved, elastic web having a continuous deformable edge, no portion of said elastic web being stiffened by folding into intersecting planes;

deforming said deformable edge and deflecting said elastic web by the impact of a body against the splash guard; and dispersing the body impact energy through deformation of the web and deformation of said continuous deformable edge so as to minimize the severity of personal injury incurred.

* * * * *